US011664182B2

(12) United States Patent
Kimura et al.

(10) Patent No.: US 11,664,182 B2
(45) Date of Patent: May 30, 2023

(54) ELECTRON EMITTING ELEMENT AND POWER GENERATION ELEMENT

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Shigeya Kimura, Kanagawa (JP); Hisashi Yoshida, Kanagawa (JP); Hisao Miyazaki, Kanagawa (JP); Hiroshi Tomita, Kanagawa (JP); Souichi Ueno, Tokyo (JP); Takeshi Hoshi, Kanagawa (JP)

(73) Assignees: Kabushiki Kaisha Toshiba, Tokyo (JP); Toshiba Energy Systems & Solutions Corporation, Kawasaki (JP)

( * ) Notice: Subject to any disclaimer, the term of this patent is extended or adjusted under 35 U.S.C. 154(b) by 118 days.

(21) Appl. No.: 17/401,823

(22) Filed: Aug. 13, 2021

(65) Prior Publication Data

US 2022/0139660 A1 May 5, 2022

(30) Foreign Application Priority Data

Nov. 2, 2020 (JP) ..... JP2020-183576

(51) Int. Cl.
*H01J 1/308* (2006.01)
*H01J 45/00* (2006.01)

(52) U.S. Cl.
CPC ..... *H01J 1/308* (2013.01); *H01J 45/00* (2013.01)

(58) Field of Classification Search
CPC ..... H01J 45/00; H01J 1/308
See application file for complete search history.

(56) References Cited

U.S. PATENT DOCUMENTS

| | | | |
|---|---|---|---|
| 6,577,058 | B2 | 6/2003 | Ossipov et al. |
| 9,564,491 | B2 | 2/2017 | Suzuki et al. |
| 9,577,146 | B2 * | 2/2017 | Chen ..... H01L 33/32 |
| 2006/0211222 | A1 | 9/2006 | Linares |
| 2008/0258133 | A1 | 10/2008 | Seong |

(Continued)

FOREIGN PATENT DOCUMENTS

| | | | |
|---|---|---|---|
| JP | H9-199001 | A | 7/1997 |
| JP | H11-232000 | A | 8/1999 |

(Continued)

*Primary Examiner* — Tae-Sik Kang
(74) *Attorney, Agent, or Firm* — Finnegan, Henderson, Farabow, Garrett & Dunner, LLP

(57) ABSTRACT

According to one embodiment, an electron emitting element includes a first region, a second region, and a third region. The first region includes a semiconductor including a first element of an n-type impurity. The second region includes diamond. The diamond includes a second element including at least one selected from the group consisting of nitrogen, phosphorous, arsenic, antimony, and bismuth. The third region is provided between the first region and the second region. The third region includes $Al_{x1}Ga_{1-x1}N$ ($0<x1\leq1$) including a third element including at least one selected from the group consisting of Si, Ge, Te and Sn. A +c-axis direction of the third region includes a component in a direction from the first region toward the second region.

20 Claims, 6 Drawing Sheets

(56) References Cited

U.S. PATENT DOCUMENTS

| | | | | |
|---|---|---|---|---|
| 2015/0075579 | A1* | 3/2015 | Kataoka | H01J 45/00<br>136/205 |
| 2018/0337317 | A1 | 11/2018 | Kimura et al. | |
| 2020/0028365 | A1 | 1/2020 | Yoshida et al. | |

FOREIGN PATENT DOCUMENTS

| | | | |
|---|---|---|---|
| JP | 2002-352694 | A | 12/2002 |
| JP | 2003-123626 | A | 4/2003 |
| JP | 2008-528420 | A | 7/2008 |
| JP | 2013-62528 | A | 4/2013 |
| JP | 2015-56995 | A | 3/2015 |
| JP | 2016-115801 | A | 6/2016 |
| JP | 2018-195790 | A | 12/2018 |
| JP | 2020-13886 | A | 1/2020 |

* cited by examiner

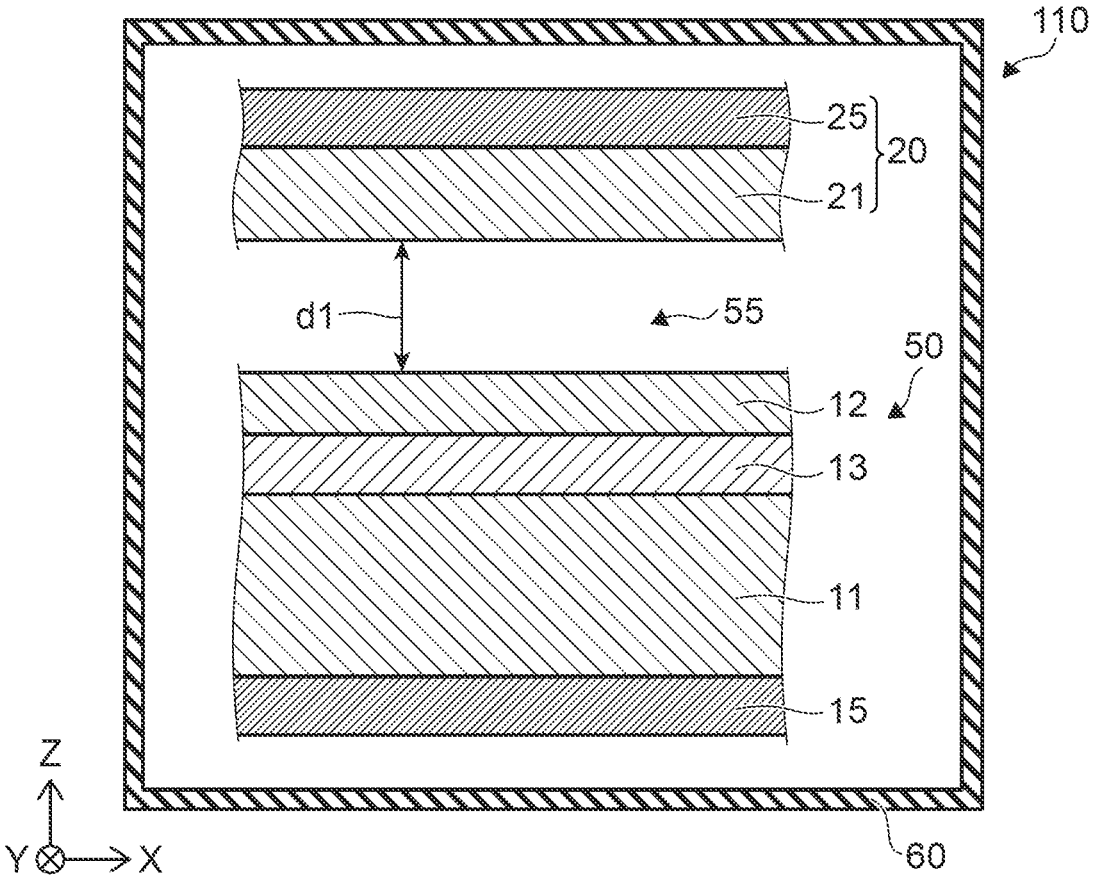
FIG. 6
FIG. 7A
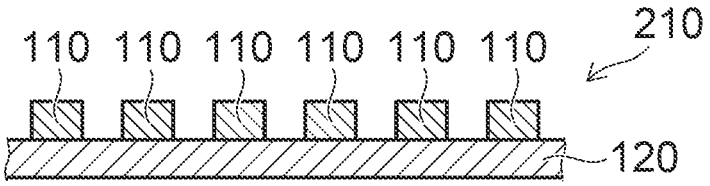
FIG. 7B
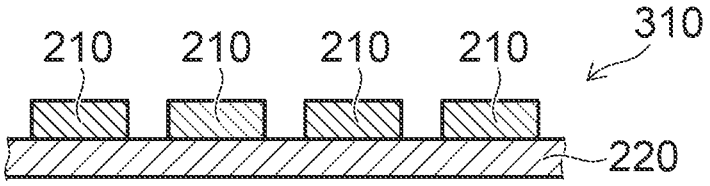

ELECTRON EMITTING ELEMENT AND POWER GENERATION ELEMENT

CROSS-REFERENCE TO RELATED APPLICATIONS

This application is based upon and claims the benefit of priority from Japanese Patent Application No. 2020-183576, filed on Nov. 2, 2020; the entire contents of which are incorporated herein by reference.

FIELD

Embodiments described herein relate generally to an electron emitting element and a power generation element.

BACKGROUND

For example, an electron emitting element is used for a power generation element or the like. It is desired to improve the efficiency of the electron emitting element.

BRIEF DESCRIPTION OF THE DRAWINGS

FIG. 6 is a schematic cross-sectional view illustrating a power generation element according to a second embodiment;

FIGS. 7A and 7B are schematic cross-sectional views showing a power generation module and a power generation device according to the embodiment.

DETAILED DESCRIPTION

Figure 1:
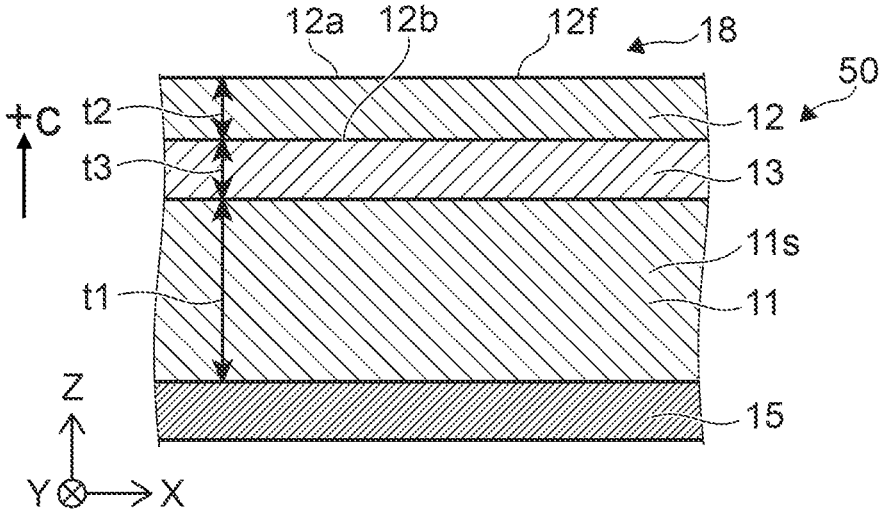
FIG. 1 is a schematic cross-sectional view illustrating an electron emitting element according to a first embodiment.

According to one embodiment, an electron emitting element includes a first region, a second region, and a third region. The first region includes a semiconductor including a first element of an n-type impurity. The second region includes diamond. The diamond includes a second element including at least one selected from the group consisting of nitrogen, phosphorous, arsenic, antimony, and bismuth. The third region is provided between the first region and the second region. The third region includes $Al_{x1}Ga_{1-x1}N$ ($0<x1\leq1$) including a third element including at least one selected from the group consisting of Si, Ge, Te and Sn. A +c-axis direction of the third region includes a component in a direction from the first region toward the second region.

According to one embodiment, a power generation element includes the electron emitting element described above, and an opposing member facing the second region. A gap is between the second region and the opposing member.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with like reference numerals, and a detailed description is omitted as appropriate.

First Embodiment

FIG. 1 is a schematic cross-sectional view illustrating an electron emitting element according to a first embodiment.

As shown in FIG. 1, an electron emitting element 50 according to the embodiment includes a first region 11, a second region 12, and a third region 13.

The first region 11 includes a semiconductor 11*s*. The semiconductor 11*s* includes a first element of an n-type impurity. The semiconductor 11*s* is an n-type semiconductor. The semiconductor 11*s* in the first region 11 includes, for example, at least one selected from the group consisting of AlGaN, GaAs, Si and SiC. An example of the semiconductor 11*s* will be described later.

The second region 12 includes diamond. Diamond includes a second element. The second element includes at least one selected from the group consisting of nitrogen, phosphorus, arsenic, antimony, and bismuth. The second element functions as an n-type impurity. The diamond in the second region 12 is n-type. The diamond in the second region 12 may include, for example, multiple crystal grains. Diamond may include, for example, polycrystals. The diamond may be, for example, a single crystal. Diamond may be, for example, nanocrystals.

The third region 13 is provided between the first region 11 and the second region 12. The third region 13 includes $Al_{x1}Ga_{1-x1}N$ ($0<x1\leq1$) including the third element. The third element includes at least one selected from the group consisting of Si, Ge, Te and Sn. The third element functions as an n-type impurity. $Al_{x1}Ga_{1-x1}N$ ($0<x1\leq1$) included in the third region 13 is an n-type. The third region 13 includes, for example, AlGaN or AlN. As will be described later, the composition ratio x1 of Al is preferably not less than 0.2. The composition ratio x1 of Al may be not less than 0.5.

The +c-axis direction of the crystal in the third region 13 includes a component in the direction from the first region 11 toward the second region 12. For example, the +c-axis direction of the third region 13 is along the direction from the first region 11 to the second region 12.

In the electron emitting element 50 according to the embodiment, electrons are emitted from a surface 12*f* of the second region 12. The electrons are, for example, thermions. For example, the surface 12*f* is exposed to a space 18. The electrons are emitted into the space 18. In the embodiment, by providing the above-mentioned third region 13, electrons can be emitted with high efficiency. Examples of electron emission characteristics will be described later.

The direction from the first region 11 toward the second region 12 is taken as a Z-axis direction. One direction perpendicular to the Z-axis direction is taken as an X-axis direction. The direction perpendicular to the Z-axis direction and the X-axis direction is taken as a Y-axis direction.

The Z-axis direction corresponds to the stacking direction of the first region 11, the third region 13, and the second region 12. The first region 11 and the third region 13 extend along the X-Y plane. In one example, the second region 12 extends along the X-Y plane. For example, the diamond included in the second region 12 may have multiple island shapes. Multiple island-shaped diamonds may be arranged along the X-Y plane.

The +c-axis direction of the crystal in the third region 13 is, for example, along the Z-axis direction. The absolute value of the angle between +c and the Z-axis direction is not more than 45 degrees. The absolute value of the angle between +c and the Z-axis direction may be not more than 10 degrees or less. If the absolute value of the angle is small, high efficiency can be easily obtained.

A thickness t1 (see FIG. 1) of the first region 11 along the Z-axis direction is, for example, not less than 100 nm or more and not more than 200 μm. A thickness t3 of the third region 13 along the Z-axis direction is, for example, not less than 5 nm and not more than 50 nm or less. A thickness t2 of the second region 12 along the Z-axis direction is, for example, not less than 5 nm and not more than 50 nm.

In the following, an example of the simulation result of the characteristics of the electron emitting device will be described.

Figure 2A:
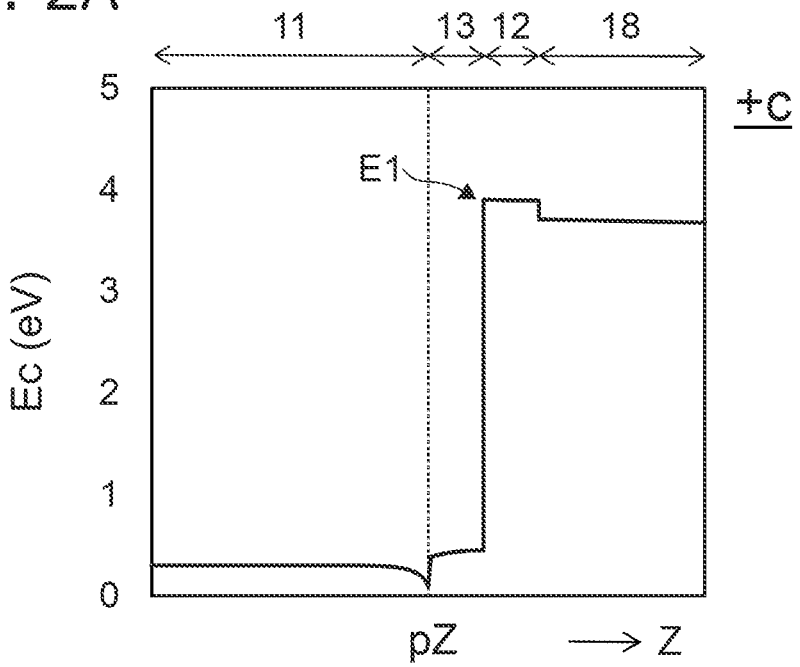
FIGS. 2A and 2B are schematic views illustrating characteristics of the electron emitting element.
Figure 2B:
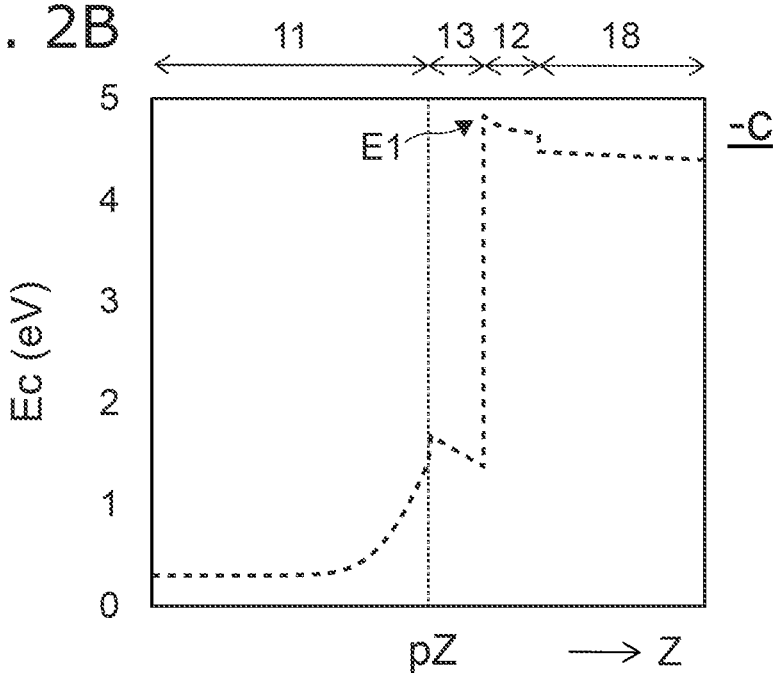

FIGS. 2A and 2B are schematic views illustrating characteristics of the electron emitting element.

The horizontal axis of these figures is the position pZ along the Z-axis direction. The vertical axis of these figures is the energy Ec. These figures illustrate the energy Ec of the conduction band. In FIG. 2A, the +c-axis direction of the third region 13 is along the direction from the first region 11 toward the second region 12. This state is referred to as "+c-axis crystal orientation". In FIG. 2B, the −c axis of the third region 13 is along the direction from the first region 11 toward the second region 12. This state is taken as the "crystal orientation of the −c axis".

In these figures, the first region 11 is GaN including Si as the first element. The temperature of the first region 11 is 600° C. The second region 12 includes an n-type diamond including N (nitrogen) as a second element. The thickness t2 of the second region 12 is 20 nm. The composition ratio x1 of Al in $Al_{x1}Ga_{1-x1}N$ of the third region 13 is 0.25. The concentration of the third element (Si) in the third region 13 is $1\times10^{14}/cm^3$. The thickness t3 of the third region 13 is 20 nm.

As shown in FIGS. 2A and 2B, the energy Ec becomes the highest at the boundary between the third region 13 and the second region 12. The energy Ec at the boundary between the third region 13 and the second region 12 is taken as the energy E1. The energy E1 in the case of "+c-axis crystal orientation" is lower than the energy E1 in the "−c-axis crystal orientation". At the low energy E1, electrons are efficiently emitted.

Figure 3:
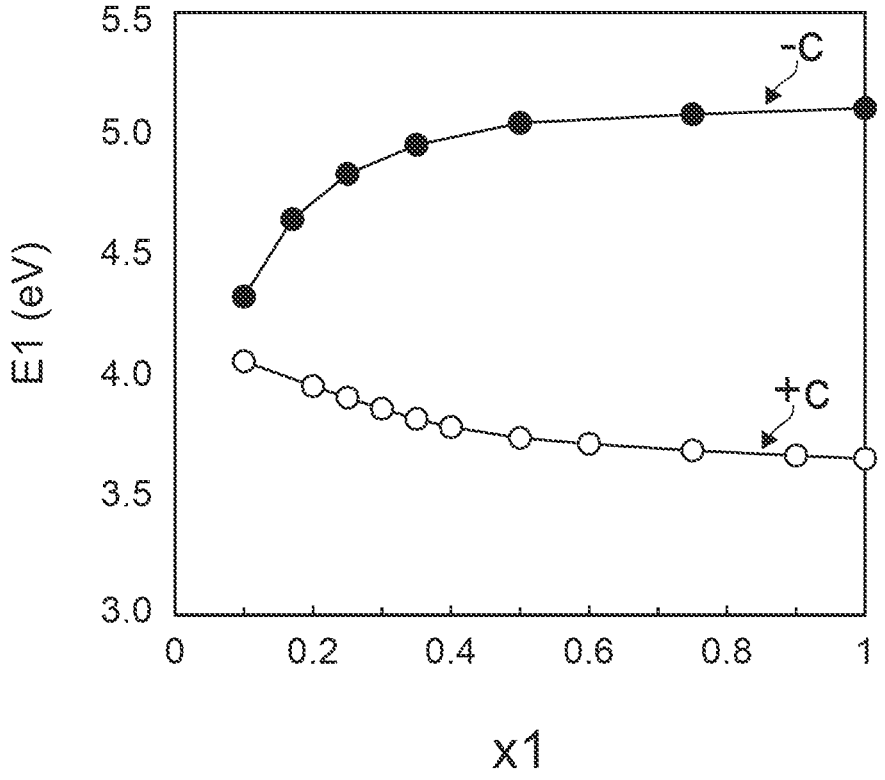
FIG. 3 is a graph view illustrating characteristics of the electron emitting element.

FIG. 3 is a graph view illustrating characteristics of the electron emitting element.

The horizontal axis of FIG. 3 is the composition ratio x1 of Al in the third region 13. The vertical axis is the energy E1. In the simulation of FIG. 3, the conditions described with respect to FIGS. 2A and 2B are adopted as the conditions other than the Al composition ratio x1. FIG. 3 shows the result in the case of "+c-axis crystal orientation" and the result in the case of "−c-axis crystal orientation".

As shown in FIG. 3, the energy E1 in the case of "+c-axis crystal orientation" is lower than the energy E1 in the case of "−c-axis crystal orientation". As described above, the low energy E1 can be obtained in a case where the crystal orientation in the third region 13 is the "+c-axis crystal orientation". In a case where the +c-axis direction of the third region 13 is the direction from the first region 11 toward the second region 12, electrons are emitted with high efficiency. According to the embodiment, it is possible to provide an electron emitting element which is possible to improve efficiency.

As shown in FIG. 3, in the case of the "+c-axis crystal orientation", when the Al composition ratio x1 in the third region 13 is high, the energy E1 is low. In the embodiment, the composition ratio x1 of Al is preferably high. In the embodiment, the composition ratio x1 of Al in the third region 13 is preferably not less than 0.2. The composition ratio x1 of Al may be not less than 0.5. The composition ratio x1 of Al may be not less than 0.8. When the composition ratio x1 of Al is high, high efficiency can be easily obtained. The composition ratio of Al may be set from the viewpoint of crystallinity and impurity concentration.

In the following, an example of the characteristics in the case of "+c-axis crystal orientation" will be described.

Figure 4:
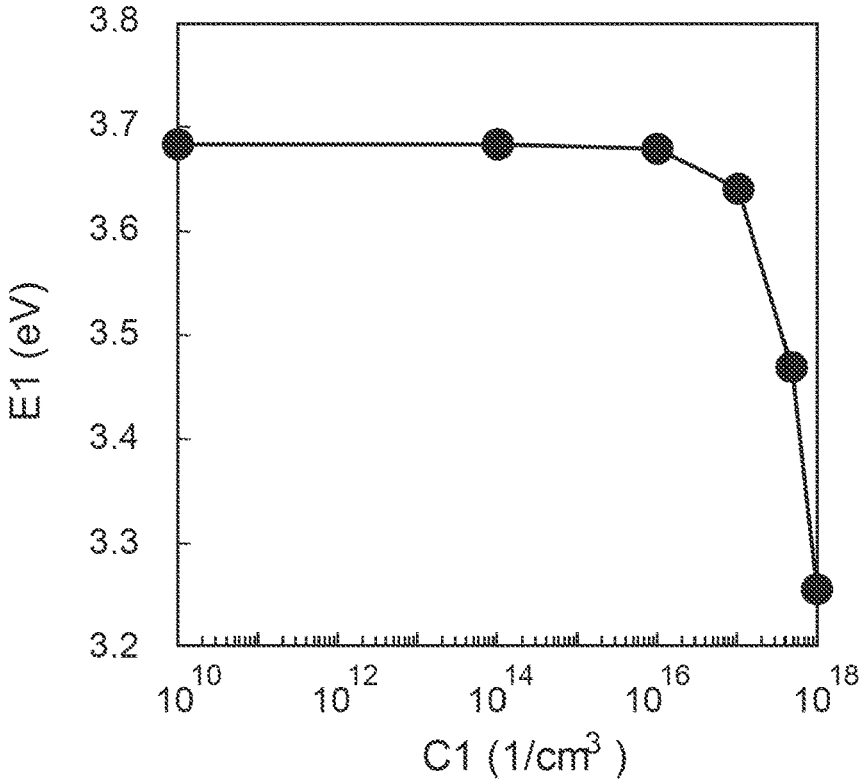
FIG. 4 is a graph view illustrating characteristics of the electron emitting element.

FIG. 4 is a graph view illustrating characteristics of the electron emitting element.

The horizontal axis of FIG. 4 is a concentration C1 of the third element in the third region 13. The vertical axis is the energy E1. In the simulation of FIG. 4, the composition ratio x1 of Al is 0.75. The concentration C1 is a concentration of Si in the third region 13. As the conditions other than the concentration C1, the conditions described with respect to FIG. 2A are adopted.

As shown in FIG. 4, in the case where the concentration C1 of the third element is high, the energy E1 is low. When the concentration C1 of the third element is high, high efficiency can be easily obtained. In the embodiment, the concentration C1 of the third element in the third region 13 is preferably not less than $1\times10^{14}/cm^3$. The concentration C1 is preferably not less than $1\times10^{16}/cm^3$. High efficiency is easy to obtain. In the embodiment, the concentration C1 is, for example, not more than $1\times10^{20}/cm^3$. If the concentration C1 exceeds $1\times10^{20}/cm^3$, for example, the crystallinity in the third region 13 may decrease and the electrical resistance may increase. When the concentration C1 is not more than $1\times10^{20}/cm^3$, low electrical resistance can be stably obtained.

Figure 5:
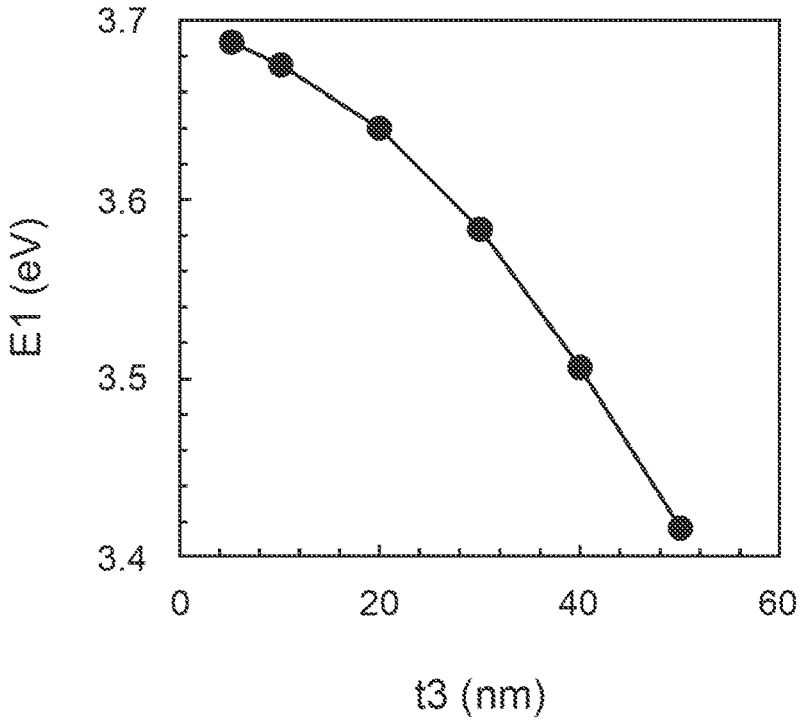
FIG. 5 is a graph view illustrating characteristics of the electron emitting element.

FIG. 5 is a graph view illustrating characteristics of the electron emitting element.

The horizontal axis of FIG. 5 is the thickness t3 of the third region 13. In the example of FIG. 5, the composition ratio x1 of Al is 0.75, and the concentration C1 of the third element is $1\times10^{17}/cm^3$. The vertical axis is the energy E1. As the conditions other than these, the conditions described with respect to FIG. 2A are adopted.

As shown in FIG. 5, when the thickness t3 of the third region 13 is thick, the energy E1 is low. In the embodiment, the thickness t3 is preferably not less than 5 nm. The thickness t3 may be not less than 10 nm. The thickness t3 may be not less than 20 nm. Low energy E1 is obtained. High efficiency can be obtained. The thickness t3 is, for example, not more than 50 nm. When the thickness t3 exceeds 50 nm, the electrical resistance tends to increase. When the thickness t3 is not more than 50 nm, low electrical resistance can be stably obtained.

In the embodiment, for example, the third region 13 including $Al_{x1}Ga_{1-x1}N$ is provided on the first region 11 including the semiconductor 11*s*. The second region 12 including diamond is provided on such the third region 13. For example, a region including a high concentration of carriers is formed in a region including the interface between the first region 11 and the third region 13. Regions including high concentrations of carriers include, for example, two-dimensional electron gases. High-concentration carriers move in the third region 13 and are released to the outside (space 18) from the surface 12*f* of the second region 12. The third region 13 is in contact with, for example, the second region 12.

In the embodiment, the semiconductor 11*s* included in the first region 11 includes, for example, $Al_{x2}Ga_{1-x2}N$ ($0 \leq x2 < 1$, $x2 < x1$). In this case, the first element includes at least one selected from the group consisting of Si, Ge, Te and Sn. High concentrations of carriers can be effectively obtained. For example, in the third region 13, good crystallinity can be easily obtained. For example, low resistance is easy to obtain.

For example, the semiconductor 11*s* may include at least one selected from the group consisting of Si and SiC. In this case, the first element includes at least one selected from the group consisting of nitrogen, phosphorus, arsenic, antimony, and bismuth. High concentrations of carriers can be effectively obtained. For example, low resistance is easy to obtain.

For example, the semiconductor 11*s* may include GaAs. In this case, the first element includes at least one selected from the group consisting of S, Se and Te. For example, low resistance is easy to obtain.

In embodiments, the surface 12*f* of the second region 12 may be terminated by H or OH. For example, as shown in FIG. 1, the second region 12 includes a first surface 12*a* and a second surface 12*b*. The second surface 12*b* is between the first surface 12*a* and the third region 13. The first surface 12*a* is the surface 12*f*. The first surface 12*a* includes at least one selected from the group consisting of hydrogen and hydroxyl groups. The first surface 12*a* becomes stable when the first surface 12*a* includes at least one selected from the group consisting of hydrogen and hydroxyl groups. Stable electron emission can be obtained.

For example, a concentration of hydrogen on the first surface 12*a* is higher than a concentration of hydrogen on the second surface 12*b*. When the concentration of hydrogen on the second surface 12*b* is high, for example, a density of holes tends to be high in the vicinity of the second surface 12*b*. When the concentration of hydrogen on the second surface 12*b* is low, for example, it is possible to suppress an increase in the density of holes. This makes it easier for electrons to be emitted from the first surface 12*a*.

As shown in FIG. 1, the electron emitting element 50 may further include a first electrode 15. There is the first region 11 between the first electrode 15 and the second region 12. The first electrode 15 is electrically connected to the first region 11. A current accompanying the emission of electrons flows through the first electrode 15.

Second Embodiment

FIG. 6 is a schematic cross-sectional view illustrating a power generation element according to a second embodiment.

As shown in FIG. 6, a power generation element 110 according to the embodiment includes the electron emitting element 50 according to the first embodiment and an opposing member 20. The opposing member 20 faces the second region 12. The opposing member 20 is conductive. For example, there is the second region 12 between the first region 11 and the opposing member 20. There is a gap 55 between the second region 12 and the opposing member 20.

For example, the first region 11 is set to a high temperature. Electrons are emitted from the surface 12*f* of the second region 12 toward the gap 55. The opposing member 20 receives electrons. The current flowing between the electron emitting element 50 and the opposing member 20 is taken out as the current of the power generation element 110.

As shown in FIG. 6, the power generation element 110 may include a container 60. The electron emitting element 50 and the opposing member 20 are provided in the container 60. The pressure inside the container 60 is lower than the atmospheric pressure. For example, the gap 55 is in a reduced pressure state. The electrons emitted from the second region 12 efficiently reach the opposing member 20.

A distance d1 between the second region 12 and the opposing member 20 along the direction from the second region 12 toward the opposing member 20 (for example, the Z-axis direction) is, for example, not less than 100 nm and not more than 1 mm. For example, high power generation efficiency can be obtained. For example, the distance d1 may be not less than 1 μm and not more than 100 μm. Higher power generation efficiency can be obtained.

As shown in FIG. 6, the opposing member 20 includes a second electrode 25 and a facing layer 21. The facing layer 21 is provided between the second region 12 and the first electrode 25. The opposing layer 21 includes, for example, at least one selected from the group consisting of diamond, AlN, AlGaN, SiC, Mo, W, $LaB_6$, and tungsten. The above-mentioned tungsten may include thorium oxide. Electrons can enter the facing layer 21 with high efficiency. The above-mentioned tungsten may include thorium oxide. For example, a region including an alkali metal may be provided on the surface of the facing layer 21 on the gap 55 side. The alkali metal includes, for example, at least one selected from the group consisting of Ba and Cs. As a result, electrons can be incident on the facing layer 21 with even higher efficiency. When the opposing layer 21 includes diamond, a region (for example, a terminal region) including at least one selected from the group consisting of hydrogen and hydroxyl groups may be provided on the surface of the opposing layer 21 on the gap 55 side.

In the following, an example of application of the power generation element will be described.

FIGS. 7A and 7B are schematic cross-sectional views illustrating a power generation module and a power generation device according to the embodiment.

As shown in FIG. 7A, a power generation module 210 according to the embodiment includes the power generation element (for example, the power generation element 110) according to the second embodiment. In this example, multiple power generation elements 110 are arranged on a substrate 120.

As shown in FIG. 7B, a power generation device 310 according to the embodiment includes the power generation module 210 described above. Multiple power generation modules 210 may be provided. In this example, the multiple power generation modules 210 are arranged on a substrate 220.

Figure 8A:
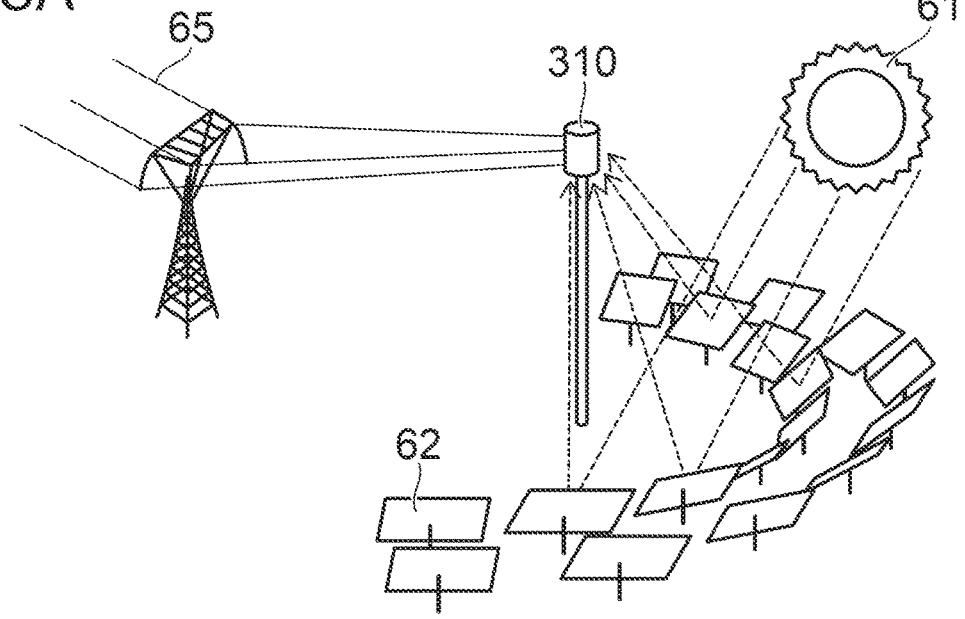
FIGS. 8A and 8B are schematic views showing the power generation device and a power generation system according to the embodiment.
Figure 8B:
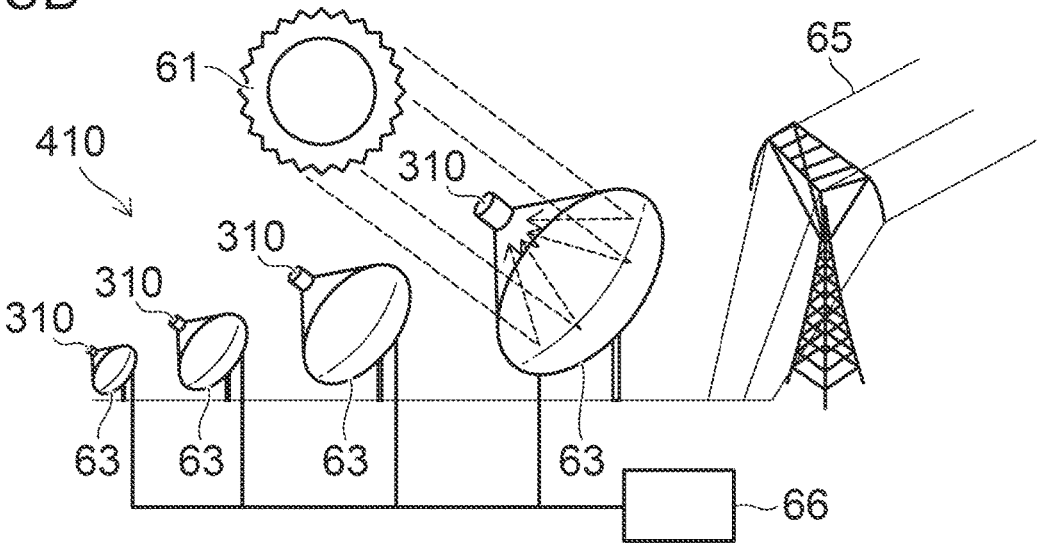

FIGS. 8A and 8B are schematic views showing the power generation device and a power generation system according to the embodiment.

As shown in FIGS. 8A and 8B, the power generation device 310 according to the embodiment (that is, the power generation element 110 according to the embodiment) can be applied to solar thermal power generation.

As shown in FIG. 8A, for example, the light from the sun 61 is reflected by a heliostat 62 and incident on the power generation device 310 (power generation element 110 or power generation module 210). The light raises the temperature of the electron emitting device. Heat is converted into a current. The current is transmitted by the electric line 65 or the like.

As shown in FIG. 8B, for example, the light from the sun 61 is collected by a condensing mirror 63 and incident on the power generation device 310 (power generation element 110 or power generation module 210). The heat from the light is converted into a current. The current is transmitted by the electric line 65 or the like.

For example, a power generation system 410 includes the power generation device 310. In this example, multiple power generation devices 310 are provided. In this example, the power generation system 410 includes power generation devices 310 and a drive device 66. The drive device 66 causes the power generation device 310 to track the movement of the sun 61. Efficient power generation can be carried out by tracking.

By using the power generation element according to the embodiment (for example, the power generation element 110), high-efficiency power generation can be performed.

The electron emitting device according to the embodiment may be used, for example, in a light emitting device, a display, an X-ray source, a magnetron, or a discharge tube (for example, a vacuum discharge tube).

According to the embodiment, an electron emitting element and a power generation element which are possible to improve efficiency can be provided.

In the specification, "a state of electrically connected" includes a state in which multiple conductors physically contact and current flows between the multiple conductors. "A state of electrically connected" includes a state in which another conductor is inserted between the multiple conductors and current flows between the multiple conductors.

Hereinabove, exemplary embodiments of the invention are described with reference to specific examples. However, the embodiments of the invention are not limited to these specific examples. For example, one skilled in the art may similarly practice the invention by appropriately selecting specific configurations of components included in electron emitting elements such as first to third regions, opposing members included in the electron emitting element, etc., from known art. Such practice is included in the scope of the invention to the extent that similar effects thereto are obtained.

Further, any two or more components of the specific examples may be combined within the extent of technical feasibility and are included in the scope of the invention to the extent that the purport of the invention is included.

Moreover, all electron emitting elements, and power generation elements practicable by an appropriate design modification by one skilled in the art based on the electron emitting elements and power generation elements described above as embodiments of the invention also are within the scope of the invention to the extent that the spirit of the invention is included.

Various other variations and modifications can be conceived by those skilled in the art within the spirit of the invention, and it is understood that such variations and modifications are also encompassed within the scope of the invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An electron emitting element, comprising:

a first region including a semiconductor including a first element of an n-type impurity;

a second region including diamond, the diamond including a second element including at least one selected from the group consisting of nitrogen, phosphorous, arsenic, antimony, and bismuth; and a third region provided between the first region and the second region, the third region including $Al_{x1}Ga_{1-x1}N$ ($0<x1\leq1$) including a third element including at least one selected from the group consisting of Si, Ge, Te and Sn, a +c-axis direction of the third region including a component in a direction from the first region toward the second region.

2. The element according to claim 1, wherein the +c-axis direction is along the direction from the first region toward the second region.

3. The element according to claim 1, wherein the x1 is not less than 0.2.

4. The element according to claim 1, wherein the x1 is not less than 0.5.

5. The element according to claim 1, wherein a concentration of the third element in the third region is not less than $1\times10^{14}/cm^3$.

6. The element according to claim 1, wherein a concentration of the third element in the third region is not less than $1\times10^{16}/cm^3$.

7. The element according to claim 5, wherein the concentration of the third element in the third region is not more than $1\times10^{20}/cm^3$.

8. The element according to claim 1, wherein a thickness of the third region along a first direction from the first region toward the second region is not less than 5 nm.

9. The element according to claim 8, wherein the thickness of the third region is not more than 50 nm.

10. The element according to claim 1, wherein the semiconductor includes $Al_{x2}Ga_{1-x2}N$ ($0\leq x2<1$, $x2<x1$), and the first element includes at least one selected from the group consisting of Si, Ge, Te and Sn.

11. The element according to claim 1, wherein the semiconductor includes at least one selected from the group consisting of Si and SiC, and the first element includes at least one selected from nitrogen, phosphorous, arsenic, antimony, and bismuth.

12. The element according to claim 1, wherein the semiconductor includes GaAs, and the first element includes at least one selected from the group consisting of S, Se and Te.

13. The element according to claim 1, wherein the second region includes a first surface and a second surface, the second surface is between the first surface and the third region, and the first surface includes at least one selected from the group consisting of hydrogen and hydroxyl group.

14. The element according to claim 1, wherein the second region includes a first surface and a second surface, the second surface is between the first surface and the third region, and a concentration of hydrogen on the first surface is higher than a concentration of hydrogen on the second surface.

15. The element according to claim 1, wherein the third region contacts the second region.

16. The element according to claim 1, wherein the diamond includes a plurality of crystal grains.

17. The element according to claim 1, further comprising:

a first electrode, the first region being between the first electrode and the second region, and the first electrode electrically connected to the first region.

18. A power generation element, comprising:

the electron emitting element according to claim 1; and an opposing member facing the second region, a gap being between the second region and the opposing member.

19. The element according to claim 18, further comprising:

a container, the electron emitting element and the opposing member are provided in the container.

20. The element according to claim 18, wherein a distance between the second region and the opposing member along a direction from the second region toward the opposing member is not less than 100 nm and not more than 1 mm.

* * * * *